United States Patent [19]

Collette

[11] 4,018,025

[45] Apr. 19, 1977

[54] VENTILATED INTERLOCKING FLOOR TILE

[75] Inventor: Roderick E. Collette, Pawling, N.Y.

[73] Assignee: Pawling Rubber Corporation, Pawling, N.Y.

[22] Filed: Nov. 28, 1975

[21] Appl. No.: 635,958

[52] U.S. Cl. ..... 52/590; 52/303; 52/392; 404/41

[51] Int. Cl.[2] ..... E04C 1/30; E04C 2/30

[58] Field of Search ..... 52/590, 392, 302, 303, 52/390; 404/32, 2, 41

[56] References Cited

UNITED STATES PATENTS

| | | | |
|---|---|---|---|
| 713,420 | 11/1902 | Flood | 52/590 X |
| 1,649,842 | 11/1927 | McBride | 52/302 |
| 2,194,653 | 3/1940 | Gell | 52/302 X |
| 2,680,698 | 6/1954 | Schnel | 404/41 X |
| 2,999,431 | 9/1961 | Mitchel | 52/590 X |
| 3,500,606 | 3/1970 | Wharmby | 52/392 X |

FOREIGN PATENTS OR APPLICATIONS

| | | | |
|---|---|---|---|
| 233,626 | 5/1925 | United Kingdom | 404/41 |
| 812,671 | 4/1959 | United Kingdom | 52/392 |
| 457,593 | 12/1936 | United Kingdom | 52/303 |

*Primary Examiner*—Alfred C. Perham
*Attorney, Agent, or Firm*—Mandeville and Schweitzer

[57] ABSTRACT

A ventilated interlocking floor tile is disclosed comprising a heavy, substantially solid edge region provided with a plurality of interlocks for attachment with contiguous tiles. The solid edge margins define a cavity on the back side of the tile, and the cavity is provided with a plurality of knob-like projections to support the tile surface while providing open space within the cavity. The solid edge regions are provided with ventilating grooves to accommodate the flow of air to and from the cavity.

5 Claims, 3 Drawing Figures

VENTILATED INTERLOCKING FLOOR TILE

BACKGROUND AND SUMMARY OF THE INVENTION

Ice skating rinks, locker rooms, weight rooms and the like require floor surfaces that provide excellent traction, prevent skate blades and cletes from dulling and which are shock absorbing, water-proof and long wearing. To meet these requirements, molded rubber floor tiles are frequently used. In certain advantageous forms, these tiles are provided with interlocks along the edges and are simply laid down side by side being interconnected by the interlocks. Once the tiles are laid down the interlocks assure non-slip adhesion.

The use of individual interlocking floor tiles permits the construction of a surface covering which may be easily adapted to different sized and shaped areas. Moreover, the tiles may be provided with interlock designs which greatly simplify installation and alleviate the need for adhesives. As a result, such floor coverings can be quickly and easily laid down and removed when necessary. In addition, the individual tiles can be easily rearranged to conform to changes in layout.

For certain end uses, conventional floor tiles of this type can present problems in that moisture can accumulate under the tiles. Wet ice skates and drippings from locker room showers result in water seeping down the seams between contiguous tiles to the floor below. With conventional floor tiles, accumulated moisture becomes trapped and cannot easily evaporate. In other words, the bottom surfaces of these floor tiles do not provide sufficient air circulation to facilitate moisture evaporation.

As its basic objective, the present invention seeks to provide an interlocking floor tile of the type described above with novel and improved features to ventilate the bottom of the floor tile and thereby hasten moisture evaporation.

Generally, the new ventilated, interlocking floor tile comprises a heavy, substantially solid edge region. The edge region is provided with a plurality of interlocks consisting of triangular-shaped projecting elements of the edge region and the dove-tailed slats formed therebetween. The projecting elements of each tile are aligned to be inserted into adjacently positioned dove-tailed slots of a contiguous tile. The solid edge region adds strength to the floor tiles in the junction area between tiles. This is advantageous since the edge regions of each tile lack the support afforded by the adjacent areas of the tile found in the inner regions thereof and are therefore subjected to the greatest stress and wear. Moreover, the triangular-shaped edge projecting elements form a firm interlock resisting separation of contiguous tiles and need maximum strength to resist this stress.

The heavy, substantially solid edge margin defines a cavity on the back side of the tile. Typically, the cavity may have a height of approximately one-third the thickness of the tile. To particular advantage this relatively shallow cavity is constructed to provide an open air space to facilitate moisture evaporation while at the same time affords an inner tile region of sufficient strength to resist wear and tear. The cavity is provided with a plurality of knob-like projections extending from the cavity wall to the floor level. To advantage, these knob-like projections support the floor surface of the tile while providing the air space within the cavity.

Moreover, the combination of cavity-and-knob back structure adds resiliency to the tile thereby providing a greater cushioning action. The improved cushioning action at the floor covering increases pedestrian comfort as well as increasing the shock-absorbing capacity thereof to help prevent injuries due to falls.

In accordance with the present invention, the interlocks of the heavy edge region of the tiles interconnect sufficiently tightly to assure a secure connection between contiguous tiles. However, a thin spacing is left between tiles and a plurality of ventilating grooves extend from the cavity to the thin spacing, accommodating the flow of air to and from the cavity and facilitating moisture evaporation. Moreover, the corners of the triangular-shaped projecting elements are rounded off to widen the spacing between tiles, facilitating air circulation without interfering with the interlock function.

With the foregoing and additional objects in view, this invention will now be described in more detail, and other objects and advantages hereof will be apparent from the following description, the accompanying drawings, and appended claims.

DETAILED DESCRIPTION OF THE PREFERRED EMBODIMENT

Figure 1:
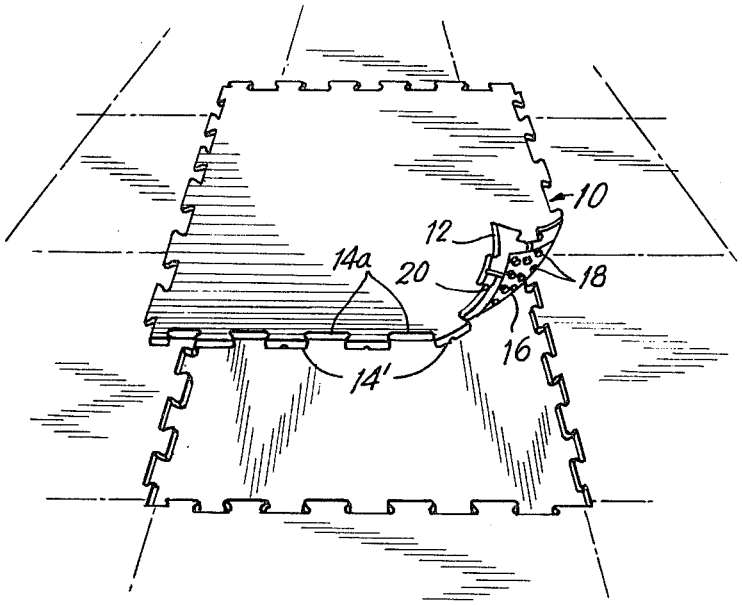
FIG. 1 is a perspective view of the ventilated floor tile of the invention showing a portion of the back side thereof.
Figure 2:
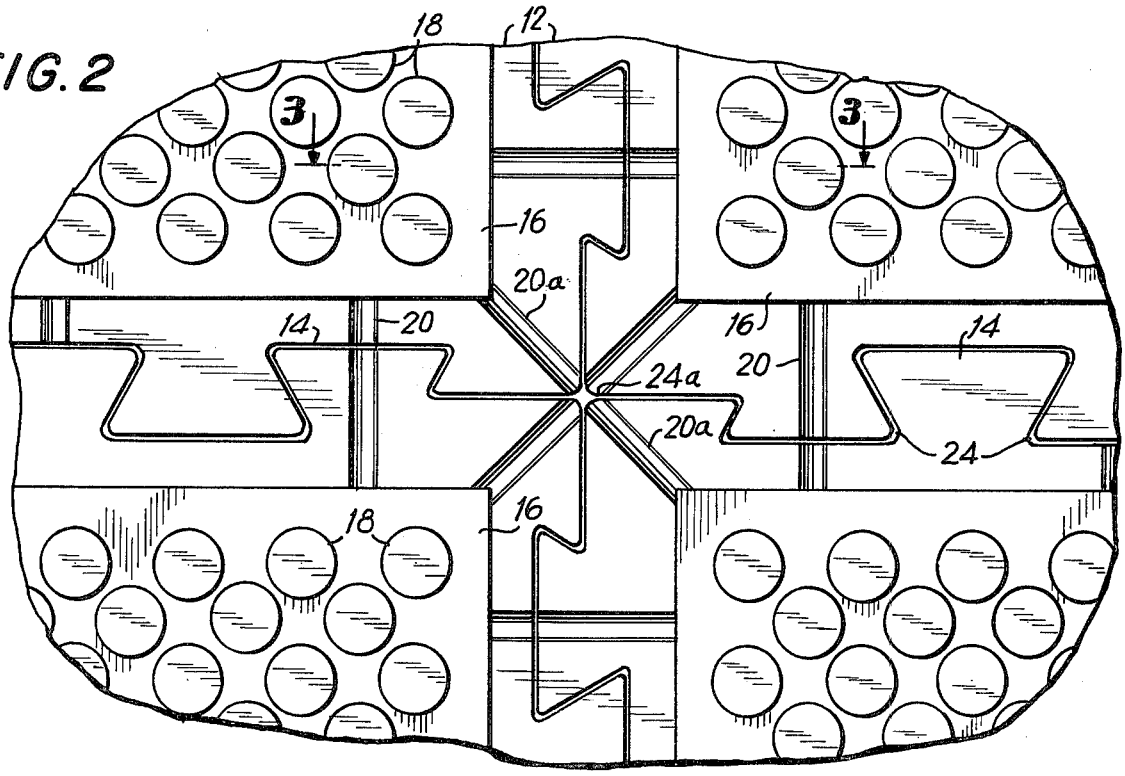
FIG. 2 is a partial bottom plan view illustrating four interconnected ventilated floor tiles of the invention.

Referring now to the drawings, FIG. 1 shows the ventilated, interlocking floor tile of the present invention, designated generally by numeral 10. The corner of the tile 10 is turned up to illustrate the back side thereof. For use in ice skating rinks and locker rooms, and similar applications, the tile 10 is preferably about two feet square. The tile 10 is provided with a heavy, substantially solid edge region 12. Shoe, clete and blade traffic generally places a stress on the tile 10 and this is particularly true in the edge area 12. As we explained above, the edge does not have the advantage of support from adjacent areas of the tile surface. As a result, the stress of traffic will tend to separate the edge region 12 from contiguous tiles 10. By providing a substantially solid edge region 12 the problem is minimized. Furthermore, the heavy edge 12 includes a plurality of interlocks comprising triangular-shaped projecting elements 14 at the edge 12 and the dove-tailed slots 14a formed therebetween. This configuration allows the projecting elements 14 of one tile 10 to interlock with adjacently positioned slots 14a of a contiguous tile 10 as is clearly illustrated in FIG. 2.

The resulting triangular interlock will tend to resist separation between tiles caused by foot traffic. Moreover, the heavy construction of the edge 14 will resist wear caused by heavy use. To achieve tight, non-slip adhesion preferably twenty extensions 14 are provided per tile 10.

The heavy edge 12 defines a cavity 16 on the back side of title 10. Though not critical to the present invention, the height of the cavity 16 advantageously is one third the thickness of tile 10. This will assure that the inner region of the tile 10 is sufficiently strong to accommodate wear and tear of normal use, while at the same time provide an air space. The cavity 16 is provided with a large plurality of knob-like projections 18. The projections 18 extend from the upper wall of the cavity to floor level. In a typical tile according to the invention there may be found four or five projections per square inch. This number of projections 18 will provide firm upward support for the surface of tile 10 and add strength and resiliency to overall tile 10, while leaving sufficient air space within cavity 16 to facilitate moisture evaporation.

Figure 3:
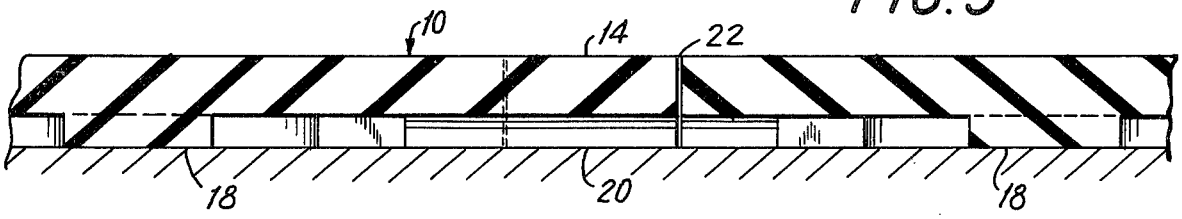
FIG. 3 is a side sectional view of the ventilated floor tile of FIG. 2, cut along line 3—3.

Referring now to FIG. 3, the projecting elements 14 are designed to interlock with the slots 14*a* of a contiguous tile 10 sufficiently tight to achieve the strong interlock required. However, normally there will be a thin spacing 22 between the tiles 10. A plurality of shallow ventilating grooves 20 are cut through the heavy edge region 12 to provide an air passage to the perimeter of edge region 12 opening to the spacing 22. Typically, there may be around three or four inch ventilating grooves 20 per side, with each ventilating groove 20 approximately three-eighths of an inch wide and cut to the same height of the cavity 16. Though the present invention is not limited by exact number and dimensions of ventilating grooves 20, this configuration will accommodate sufficient air flow from the cavity 16 to the spacing 22 to achieve an adequate rate of evaporation for trapped moisture.

Advantageously, the corners 24 of the projecting elements 14 are rounded out to widen the spacing 22 in these areas. This further facilitates air flow to and from the cavity 16.

In the illustrated form of the invention corner ventilating grooves 20*a* are cut through the edge region 12 from the cavity 16 to the tile corner 24*a*. Typically, the corner grooves 20*a* form a 45° angle with the perimeter of the edge region 12 The tile corners 24*a* are also rounded to define a spacing (e.g. ⅛ inch) between contiguous tiles 10 to accommodate the flow of ventilating air. To advantage, this unique arrangement of angled corner grooves 20*a* and rounded tile corners 24*a* improves the overall air flow under tiles 10.

The ventilated, interlocking floor tile of the present invention therefore affords all of the advantages of the molded rubber floor tiles used heretofore and adds several novel features which greatly increase their efficacy. The heavy, substantially solid edge region maintains full strength in the critical junction areas of the tile and at the same time defines a cavity to provide an open air space for trapped moisture. The knob-like projections provide strength and support for the tile while leaving sufficient air space within the cavity for evaporation. The unique interlock configuration and ventilating grooves provide a highly effective means for air circulation. The air circulation expedites evaporation of trapped moisture and thereby reduces adverse effects such as rot and mildew.

While the particular ventilated floor tile described herein is one embodiment of this invention, this invention is not limited to that particular arrangement and, as will be appreciated and understood by those skilled in the art, changes may be made therein without departing from the scope of the invention which is defined in the appended claims.

I claim:

1. A ventilated, interlocking floor tile, which comprises a. a heavy, substantially solid edge region, the periphery of said edge region provided with a plurality of interlocks to interconnect said tile with contiguous tiles whereby a floor surface covering can be constructed, b. said interlocks comprising projecting elements extending from said edge region and alternating dove tailed slots formed thereby, c. said projecting elements interlocking with the adjacently positioned dove tail slots of a contiguous tile, d. said tile including an inner region integral with said heavy, substantially solid edge region, e. said heavy edge region defining a cavity on the back side of said tile beneath said inner region, whereby said heavy, substantially solid edge region provides added support to the tile at the junction area between contiguous tiles and said tile contains an open air space beneath said inner region, f. said cavity including a plurality of knob-like projections extending from the back side of said tile at said inner region to floor level to support said tile, while providing an air space within said cavity, and g. said heavy edge region including ventilating grooves extending from the cavity to the tile edges to accommodate the flow of air to and from said cavity.

2. The ventilated, interlocking floor tile of claim 1, further characterized by a. the corners of said projecting elements being rounded to widen said space in their area thereby further improving said air flow between adjacent tiles.

3. The ventilated, interlocking floor tile of claim 1, further characterized by a. said cavity being shallow relative to the tile thickness and including a substantial plurality of knob-like projections, whereby said tile is of a strong construction and provided with an open air space.

4. The ventilated, interlocking floor tile of claim 1, further characterized by a. said heavy edge region including corner ventilating grooves extending from said cavity to the tile corners.

5. The ventilated, interlocking floor tile of claim 4, further characterized by a. said tile corners being rounded to define a spacing between contiguous tiles to accommodate the flow of air to and from said cavity.

* * * * *